US012091620B2

(12) United States Patent
Murray et al.

(10) Patent No.: US 12,091,620 B2
(45) Date of Patent: Sep. 17, 2024

(54) SYSTEMS AND PROCESSES FOR PROCESSING PYROLYSIS OIL

(71) Applicant: Chevron Phillips Chemical Company LP, The Woodlands, TX (US)

(72) Inventors: Bruce D. Murray, Kingwood, TX (US); Scott G. Morrison, Kingwood, TX (US); Kenneth Fountain, Biloxi, MS (US); Steven R. Horlacher, League City, TX (US); Vincent D. Mcgahee, Kemah, TX (US); Reza Khankal, Humble, TX (US); David Dockter, Kingwood, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 0 days.

(21) Appl. No.: 18/444,846

(22) Filed: Feb. 19, 2024

(65) Prior Publication Data

US 2024/0191149 A1 Jun. 13, 2024

Related U.S. Application Data

(62) Division of application No. 18/464,570, filed on Sep. 11, 2023, which is a division of application No. 18/054,169, filed on Nov. 10, 2022, now Pat. No. 11,802,250.

(51) Int. Cl.

| | |
|---|---|
| ***C10G 69/14*** | (2006.01) |
| ***C10G 1/00*** | (2006.01) |
| ***C10G 1/10*** | (2006.01) |
| ***C10G 67/16*** | (2006.01) |
| ***C10G 69/08*** | (2006.01) |
| ***C10G 69/12*** | (2006.01) |

(52) U.S. Cl.

CPC ..... *C10G 69/14* (2013.01); *C10G 1/002* (2013.01); *C10G 1/10* (2013.01); *C10G 67/16* (2013.01); *C10G 69/08* (2013.01); *C10G 69/126* (2013.01); *C10G 2300/1003* (2013.01); *C10G 2400/20* (2013.01); *C10G 2400/30* (2013.01)

(58) Field of Classification Search

CPC ..... B01J 2219/00006

See application file for complete search history.

(56) References Cited

U.S. PATENT DOCUMENTS

| | | | | |
|---|---|---|---|---|
| 11,807,815 | B2 | 11/2023 | Koseoglu | |
| 2021/0130716 | A1* | 5/2021 | Xu | B01D 3/143 |
| 2022/0098490 | A1* | 3/2022 | Abbott | C10G 9/00 |
| 2022/0340820 | A1* | 10/2022 | Abbott | C10G 1/086 |
| 2023/0257661 | A1 | 8/2023 | Koseoglu | |
| 2024/0043751 | A1 | 2/2024 | Koseoglu | |

FOREIGN PATENT DOCUMENTS

WO WO-2013169464 A1 * 11/2013 ..... B01J 29/40

* cited by examiner

*Primary Examiner* — Randy Boyer

(74) *Attorney, Agent, or Firm* — Eversheds Sutherland (US) LLP

(57) ABSTRACT

A system for processing plastic waste may include a feed line, a feed fractionator, a hydrotreater, a catalytic reforming unit, a heavy oil cracker, and a steam cracker. A pyrolyzed plastics feed is separated into light, medium, and heavy hydrocarbon streams. The hydrotreater removes sulfur, and the catalytic reforming unit produces a circular aromatic-rich stream. The heavy oil cracker generates cracked streams. The steam cracker produces a circular olefin stream from a cracked stream. A system for processing plastic waste may include the feed line, the feed fractionator, the hydrotreater, a medium hydrocarbon fractionator, the catalytic reforming unit, a full-range reforming unit, the heavy oil cracker, and the steam cracker. The medium hydrocarbon fractionator produces two hydrocarbon streams. The full-range naphtha reforming unit produces a second circular aromatic-rich stream.

19 Claims, 4 Drawing Sheets

SYSTEMS AND PROCESSES FOR PROCESSING PYROLYSIS OIL

CROSS-REFERENCE TO RELATED APPLICATIONS

This application claims priority to U.S. application Ser. No. 18/464,570, filed Sep. 11, 2023, which claims priority to U.S. application Ser. No. 18/054,169, filed Nov. 10, 2022, both of which are incorporated herein by reference.

TECHNICAL FIELD

This disclosure relates to systems and processes for processing pyrolysis oil, and more specifically, systems and processes for processing pyrolysis oil to produce chemicals or polymers from plastic waste.

BACKGROUND

Recycling of plastic materials involves processing plastic waste to produce raw materials, which can be processed to produce recycled plastic. For example, waste plastic materials may be thermally processed to produce a pyrolysis oil. The pyrolysis oil is carbon-rich, and can be processed to derive one or more components that may be serve as raw materials, intermediates, or adjuncts for ultimately producing recycled plastics. A number of producers produce pyrolysis oils from various waste plastics, including polystyrene, polyethylene, and polypropylene. Pyrolysis oil contains numerous hydrocarbon components, similar to crude oil. Pyrolysis oil may be further refined, processed, or treated to extract one or more components or streams of interest. In addition to useful components, pyrolysis oil also tends to include contaminants originating from the recycled plastics used as a source.

A need remains for systems and processes to process pyrolysis oil to produce chemicals or polymers from plastic waste.

SUMMARY OF THE DISCLOSURE

This summary is provided to introduce various concepts in a simplified form that are further described below in the detailed description. This summary is not intended to identify required or essential features of the claimed subject matter nor is the summary intended to limit the scope of the claimed subject matter.

In aspects according to the present disclosure, a system for producing chemicals or polymers from plastic waste includes a feed line, a feed fractionator, a hydrotreater, a catalytic reforming unit, a heavy oil cracker, and a steam cracker. The feed line includes a pyrolyzed plastics feed. The feed fractionator is coupled to the feed line for separating the pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_8$ circular hydrocarbons. The heavy hydrocarbon stream includes $C_9$ or higher circular hydrocarbons. The hydrotreater is fluidically coupled to the feed fractionator to receive the medium hydrocarbon stream and configured to desulfurize the medium hydrocarbon stream to produce a circular hydrotreated hydrocarbon stream. The catalytic reforming unit includes a zeolitic reforming catalyst comprising platinum on a bound zeolite support. The catalytic reforming unit is fluidically coupled to the hydrotreater to receive the circular hydrotreated hydrocarbon stream and produce a circular aromatic-rich stream. The heavy oil cracker is fluidically coupled to the feed fractionator to receive the heavy hydrocarbon stream and generate a first cracked stream including $C_6$ or higher circular hydrocarbons and a second cracked stream including $C_5$ or lower circular hydrocarbons. The steam cracker is fluidically coupled to the heavy oil cracker to receive the first cracked stream and produce a circular olefin stream.

In aspects according to the present disclosure, a process for producing chemicals or polymers from plastic waste includes fractionating a pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_8$ circular hydrocarbons. The heavy hydrocarbon stream includes $C_9$ or higher circular hydrocarbons. The process further includes hydrotreating the medium hydrocarbon stream to desulfurize the medium hydrocarbon stream to produce a hydrotreated hydrocarbon stream. The process further includes catalytically reforming the hydrotreated stream over a zeolitic reforming catalyst comprising platinum on a bound zeolite support to produce a circular aromatic-rich stream. The process further includes cracking the heavy hydrocarbon stream to generate a first cracked stream including $C_6$ or higher circular hydrocarbons and a second cracked stream including $C_5$ or lower circular hydrocarbons. The process further includes steam cracking the first cracked stream to produce a circular olefin stream.

In aspects according to the present disclosure, a system for producing chemicals or polymers from plastic waste includes a feed line, a feed fractionator, a hydrotreater, a medium hydrocarbon fractionator, an catalytic reforming unit, a full-range naphtha reforming unit, a heavy oil cracker, and a steam cracker. The feed line includes a pyrolyzed plastics feed. The feed fractionator is coupled to the feed line for separating the pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_{12}$ circular hydrocarbons. The heavy hydrocarbon stream includes $C_{13}$ or higher circular hydrocarbons. The hydrotreater is fluidically coupled to the feed fractionator to receive the medium hydrocarbon stream and configured to desulfurize the medium hydrocarbon stream to produce a hydrotreated hydrocarbon stream. The medium hydrocarbon fractionator is fluidically coupled to the hydrotreater to receive the hydrotreated hydrocarbon stream and produce a first fractionated medium hydrocarbon stream including $C_6$ to $C_8$ circular hydrocarbons and a second fractionated medium hydrocarbon stream including $C_9$ to $C_{12}$ circular hydrocarbons. The catalytic reforming unit includes a zeolitic reforming catalyst comprising platinum on a bound zeolite support. The catalytic reforming unit is fluidically coupled to the medium hydrocarbon fractionator to receive the first fractionated medium stream and produce a first circular aromatic-rich stream. The full-range naphtha reforming unit includes a catalyst and is fluidically coupled to the medium hydrocarbon fractionator to receive the second fractionated medium stream and produce a second circular aromatic-rich stream. The heavy oil cracker is fluidically coupled to the feed fractionator to receive the heavy hydrocarbon stream and generate a first cracked stream including $C_6$ or higher circular hydrocarbons and a second cracked stream including $C_5$ or lower circular hydrocarbons. The steam cracker is fluidically coupled to the heavy oil cracker to receive the first cracked stream and produce a circular olefin stream.

In aspects according to the present disclosure, a process for producing chemicals or polymers from plastic waste includes fractionating a pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_{12}$ circular hydrocarbons. The heavy hydrocarbon stream includes $C_{13}$ or higher circular hydrocarbons. The process further includes hydrotreating the medium hydrocarbon stream to desulfurize the medium hydrocarbon stream to produce a hydrotreated hydrocarbon stream. The process further includes fractionating the hydrotreated hydrocarbon stream to produce a first fractionated medium hydrocarbon stream including $C_6$ to $C_8$ hydrocarbons and a second fractionated medium hydrocarbon stream including $C_9$ to $C_{12}$ hydrocarbons. The process further includes catalytically reforming the first medium hydrocarbon stream over a zeolitic reforming catalyst comprising platinum on a bound zeolite support to produce a first circular aromatic-rich stream. The process further includes continuously catalytically reforming the second medium hydrocarbon stream over a catalyst to produce a second circular aromatic-rich stream. The process further includes cracking the heavy hydrocarbon stream to generate a first cracked stream including $C_6$ or higher circular hydrocarbons and a second cracked stream including $C_5$ or lower circular hydrocarbons. The process further includes steam cracking the first cracked stream to produce a circular olefin stream.

This summary and the following detailed description provide examples and are explanatory only of the disclosure. Accordingly, the foregoing summary and the following detailed description should not be considered to be restrictive. Additional features or variations thereof can be provided in addition to those set forth herein, such as for example, various feature combinations and sub-combinations of these described in the detailed description.

BRIEF DESCRIPTION OF THE DRAWINGS

The following figures form a part of the present disclosure and are included to further demonstrate certain aspects of the present disclosure. The disclosure may be better understood by reference to one or more of these figures in combination with the detailed description of the specific embodiments presented herein.

Figure 1:
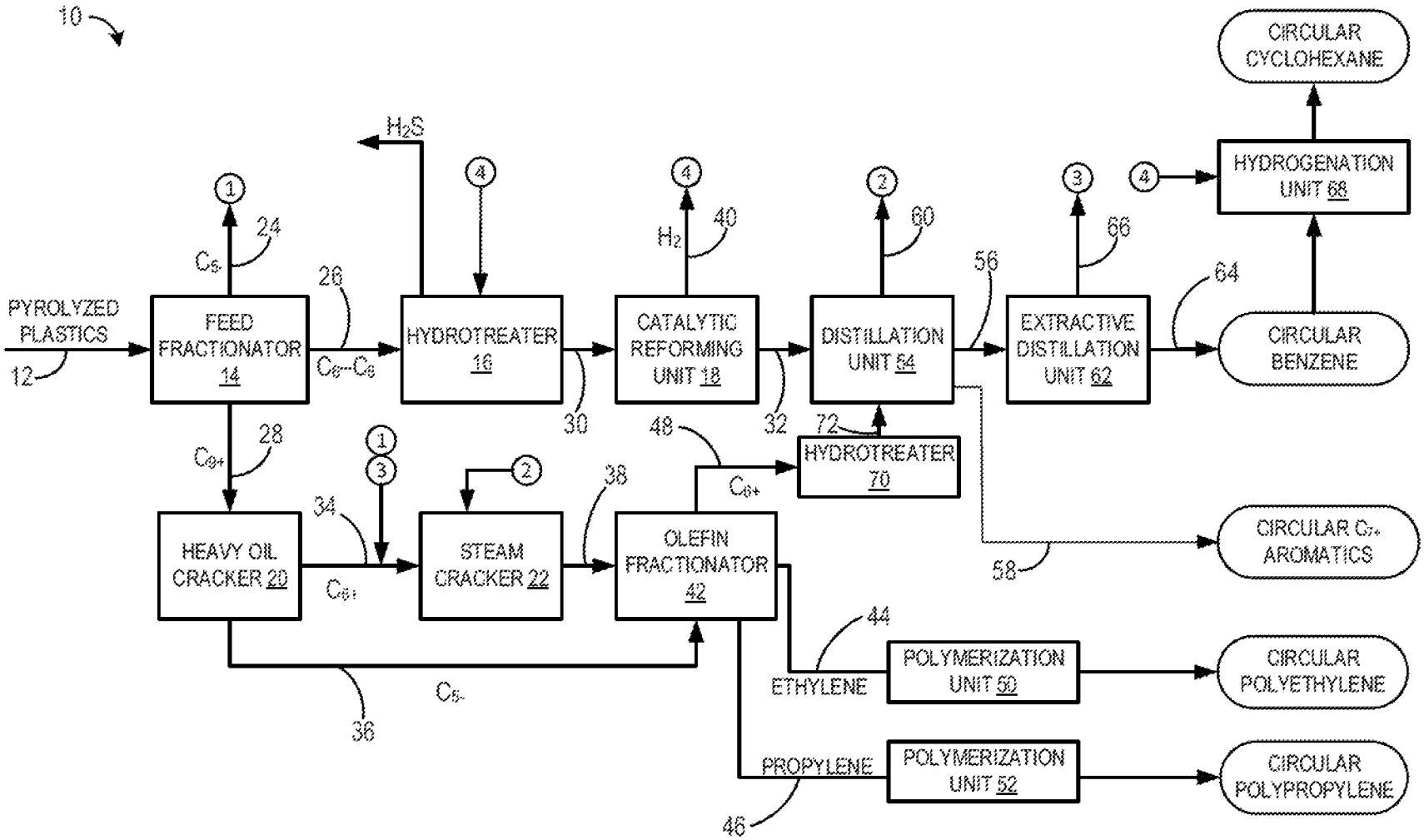
FIG. 1 is a conceptual block diagram of a system for producing chemicals or polymers from plastic waste.

While the technologies disclosed herein are susceptible to various modifications and alternative forms, only a few specific aspects have been shown by way of example in the drawings and are described in detail below. The figures and detailed descriptions of these specific aspects are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

It is to be understood that the disclosure is not limited in its application to the details of construction and the arrangement of components set forth in the following description or illustrated in the drawings.

Definitions

To define more clearly the terms used herein, the following definitions are provided. Unless otherwise indicated, the following definitions are applicable to this disclosure. If a term is used in this disclosure but is not specifically defined herein, the definition from the IUPAC Compendium of Chemical Terminology, 2nd Ed (1997) can be applied, as long as that definition does not conflict with any other disclosure or definition applied herein or render indefinite or non-enabled any claim to which that definition is applied. To the extent that any definition or usage provided by any document incorporated herein by reference conflicts with the definition or usage provided herein, the definition or usage provided herein controls.

While compositions and methods are described in terms of "comprising" various components or steps, the compositions and methods can also "consist essentially of" or "consist of" the various components or steps, unless stated otherwise.

The terms "a," "an," and "the" are intended to include plural alternatives, e.g., at least one. The terms "including," "with," and "having," as used herein, are defined as comprising (i.e., open language), unless specified otherwise.

The term "circular" refers to chemicals (for example, monomers and polymers) that are derived from waste materials (for example, waste plastics).

The term "pyrolysis oil" (also known as "pyrolyzed plastics feed") refers to a product prepared by pyrolysis of waste plastics.

The term "fraction" refers to a portion of a stream separated by boiling point and characterized by the relative number of carbon atoms in the hydrocarbon components. For example, a "$C_6$-$C_{12}$ fraction" would contain predominantly hydrocarbons with six to 12 carbons, with only impurity levels of hydrocarbons with 5 or 11 carbons. Similarly, a "$C_{5+}$ fraction" would contain predominantly hydrocarbons with five or more carbons, with only impurity levels of hydrocarbons with 4 carbons.

The terms "light," "medium," and "heavy" refer to relative size of the hydrocarbons in the fraction characterized by the number of carbons in the hydrocarbon judged in comparison to either a specific hydrocarbon stream or in comparison to other hydrocarbons exiting or entering a given system or a given process. The terms may refer to different fractions in different processes and systems. For example, a "medium" fraction described with reference to one system or process may overlap with a "light" or "heavy" fraction described with reference to another system or process. Likewise, a "medium" fraction described with reference to one system or process may become a "light" or "heavy" fraction when described with reference to a different system or process. The terms are defined herein, as appropriate, with respect to the average number of carbon atoms in streams described with reference to particular fractions, systems and processes.

Various numerical ranges are disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. For example, all numerical end points of ranges disclosed herein are approximate, unless excluded by proviso.

Values or ranges may be expressed herein as "about," from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means±20% of the stated value, ±15% of the stated value, ±10% of the stated value, ±5% of the stated value, ±3% of the stated value, or ±1% of the stated value.

Applicant reserves the right to proviso out or exclude any individual members of any such group of values or ranges, including any sub-ranges or combinations of sub-ranges within the group, that can be claimed according to a range or in any similar manner, if for any reason Applicant chooses to claim less than the full measure of the disclosure, for example, to account for a reference that Applicant may be unaware of at the time of the filing of the application. Further, Applicant reserves the right to proviso out or exclude any individual substituents, analogs, compounds, ligands, structures, or groups thereof, or any members of a claimed group, if for any reason Applicant chooses to claim less than the full measure of the disclosure, for example, to account for a reference that Applicant may be unaware of at the time of the filing of the application.

Although any methods and materials similar or equivalent to those described herein can be used in the practice or testing of the disclosure, the typical methods and materials are herein described.

All publications and patents mentioned herein are incorporated herein by reference for the purpose of describing and disclosing, for example, the constructs and methodologies that are described in the publications, which might be used in connection with the present disclosure. The publications discussed throughout the text are provided solely for their disclosure prior to the filing date of the present application. Nothing herein is to be construed as an admission that the inventors are not entitled to antedate such disclosure by virtue of prior disclosure.

Processing of waste plastic produces a pyrolysis oil. The pyrolysis oil may eventually be processed into circular polymers, for example, based on an aromatic chain or an olefin chain. For example, aromatics-based polymers may include polyethylene terephthalate (PET), polystyrene (PS), or nylon), and olefin-based polymers may include polyethylene (PE) or polypropylene (PP). To produce these polymers, the pyrolysis oil may initially be processed to produce appropriate monomers such as circular benzene, circular xylene, circular ethylene, and circular propylene. Polymers subsequently prepared from these circular monomers can be considered to be circular polymers, since they are ultimately formed from circular monomers. Thus, instead of recycling a particular kind of plastic waste into substantially the same type or class of recycled polymer (for example, polyolefin waste into recycled polyolefin), pyrolysis oil may be formed to permit a relatively larger class of recycled plastic materials to be produced from plastic waste.

Pyrolysis oil includes a number of hydrocarbon fractions. If the fractions are not utilized effectively to produce recycled plastics, remaining hydrocarbon fractions of a pyrolysis oil are typically used as fuel, for example, as a component of jet or automotive fuel. However, such use as fuel may ultimately reduce the amount of plastic waste recycled into recycled plastic or circular polymer. Systems and processes according to the present disclosure may be used to substantially extract a larger number of useful fractions or a larger volume of said fractions from pyrolysis oil to prepare a number of circular monomers, which may thus reduce or prevent a need to use portions or fractions of pyrolysis oil as fuel. Thus, the loss of potential circular feedstock to fuel may be reduced or prevented.

Cracking and/or catalytic reforming may be used to process pyrolysis oil. However, the presence of contaminants in waste plastics, for example, sulfur-based or other contaminants, may reduce the efficacy of catalytic reforming, or prevent its use altogether if contamination increases beyond permissible limits. Systems and processes according to the present disclosure provide hydrotreatment to reduce or substantially remove contaminants from plastics wastes, for example, contaminants that may tend to interfere with cracking and/or catalytic reforming, or contaminants that may otherwise be undesirable in intermediate processing streams, or in the circular monomers or circular polymers ultimately produced from pyrolysis oil.

In aspects, different hydrocarbon fractions of the pyrolysis oil may be processed in crackers or reformers. For example, a $C_{7+}$ fraction may be processed in a heavy oil cracker, or a $C_7$-$C_{12}$ fraction may be processed in a traditional reformer with a $C_{12+}$ fraction being processed in a heavy oil cracker and/or steam cracker. Heavy hydrocarbon fractions from the cracker may be routed to a reformer distillation train for aromatics recovery. Circular olefins and aromatics may thus be obtained, and used to produce circular downstream polymers and chemicals.

Different treatment schemes may be used for processing pyrolysis oil. For example, pyrolysis oil may be processed with expanded catalytic reforming feed preparation, and with a heavy oil cracker. The catalytic reforming feed preparation may be used to handle a full pyrolysis oil feed with $C_{7+}$ naphtha routed to a heavy oil cracker. The heavy oil cracker may produce a light feed routed to a steam cracker for olefin/polyolefin production. A single cracker, for example, a crude oil cracker, may be used instead of the combination of a heavy oil cracker and a steam cracker. Such a process may provide recovery of more circular pyrolysis oil as olefins/polyolefins, and provide maximum circularity without free attribution in circular stream calculations.

Alternatively, pyrolysis oil may be treated in a catalytic reforming unit and a full-range naphtha reforming unit, and in combination with a heavy oil cracker. For example, the full-range naphtha reforming unit may enable processing heavy naphtha. In aspects the full-range naphtha reforming unit is a fixed bed reformer. In other aspects the full-range naphtha reforming unit is a semi-regen naphtha reforming unit such as a Rheniforming semi-regen technology. In still future aspects the full-range naphtha reforming unit is a continuous catalytic reforming unit (CCR) such as a Aromizing™ CCR process available from Axens; or CCR Platforming™ process available from Honeywell UOP. The combination of a catalytic reformer with a full range naphtha reformer can be referred to as split feed reforming. Such a process may provide recovery of more circular pyrolysis oil without free attribution in circular stream calculations, with less valuable fractions potentially being directed to form mixed-aromatics streams including para-xylene.

In aspects according to the present disclosure, a system for producing chemicals or polymers from plastic waste includes a feed line, a feed fractionator, a hydrotreater, a catalytic reforming unit, a heavy oil cracker, and a steam cracker. The feed line includes a pyrolyzed plastics feed. The feed fractionator is coupled to the feed line for separating the pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream comprises $C_6$-$C_8$ circular hydrocarbons. The heavy hydrocarbon stream comprises $C_9$ or higher circular hydrocarbons. The hydrotreater is fluidically coupled to the feed fractionator to receive the medium hydrocarbon stream and configured to desulfurize the medium hydrocarbon stream to produce a circular hydrotreated hydrocarbon stream. The catalytic reforming unit includes a zeolitic reforming catalyst comprising platinum on a bound zeolite support. The catalytic reforming unit is fluidically coupled to the hydrotreater to receive the circular hydrotreated hydrocarbon stream and produce a circular aromatic-rich stream. The heavy oil cracker is fluidically coupled to the feed fractionator to receive the heavy hydrocarbon stream and generate a first cracked stream comprising $C_6$ or higher circular hydrocarbons and a second cracked stream comprising $C_5$ or lower circular hydrocarbons. The steam cracker is fluidically coupled to the heavy oil cracker to receive the first cracked stream and produce a circular olefin stream.

In aspects according to the present disclosure, a process for producing chemicals or polymers from plastic waste includes fractionating a pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_8$ circular hydrocarbons. The heavy hydrocarbon stream includes $C_9$ or higher circular hydrocarbons. The process further includes hydrotreating the medium hydrocarbon stream to desulfurize the medium hydrocarbon stream to produce a hydrotreated hydrocarbon stream. The process further includes catalytically reforming the hydrotreated stream over a zeolitic reforming catalyst comprising platinum on a bound zeolite support to produce a circular aromatic-rich stream. The process further includes cracking the heavy hydrocarbon stream to generate a first cracked stream including $C_6$ or higher circular hydrocarbons and a second cracked stream including $C_5$ or lower circular hydrocarbons. The process further includes steam cracking the first cracked stream to produce a circular olefin stream.

In an aspect, the bound zeolite support comprises one or more zeolite powders that are joined together by a binder. The term "zeolite" generally refers to a particular group of crystalline metal aluminosilicates. These zeolites exhibit a network of $SiO_4$ and $AlO_4$ tetrahedra in which aluminum and silicon atoms are crosslinked in a three-dimensional framework by sharing oxygen atoms. In the framework, the ratio of oxygen atoms to the total of aluminum and silicon atoms is equal to 2. The framework exhibits a negative electrovalence that typically is balanced by the inclusion of cations within the crystal such as metals, alkali metals, alkaline earth metals, or hydrogen. Thus, zeolites are a group of natural or synthetic aluminosilicate minerals that typically contain alkali and alkaline metals. Zeolites are characterized by a framework structure that encloses interconnected cavities occupied by ion-exchangeable large metal cations such as potassium and water molecules permitting reversible dehydration. The actual formula of the zeolite may vary without changing the crystalline structure. In an aspect, the mole ratio of silicon to aluminum (Si/Al) in the zeolite may vary from about 1.0 to about 3.5.

In an aspect, the bound zeolite support comprises a large-pore zeolite. The term "large-pore zeolite" as used herein refers to a zeolite having an effective pore diameter of from about 6 Angstroms (Å) (0.6 nm) to about 15 Å (1.5 nm), alternatively from about 7 Å (0.7 nm) to about 9 Å (0.9 nm). Large pore crystalline zeolites suitable for use in this disclosure include without limitation L-zeolite, X-zeolite, Y-zeolite, omega zeolite, beta zeolite, ZSM-4, ZSM-5, ZSM-10, ZSM-12, ZSM-20, REY, USY, RE-USY, LZ-210, LZ-210-A, LZ-210-M, LZ-210-T, SSZ-24, SSZ-26, SSZ-31, SSZ-33, SSZ-35, SSZ-37, SSZ-41, SSZ-42, SSZ-44, MCM-58, mordenite, faujasite, or combinations thereof. In an aspect, the large pore zeolite has an isotypic framework structure. In an aspect, the bound zeolite support comprises L-zeolite.

In aspects according to the present disclosure, a system for producing chemicals or polymers from plastic waste includes a feed line, a feed fractionator, a hydrotreater, a medium hydrocarbon fractionator, a catalytic reforming unit, a full-range naphtha reforming unit, a heavy oil cracker, and a steam cracker. The feed line includes a pyrolyzed plastics feed. The feed fractionator is coupled to the feed line for separating the pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_{12}$ circular hydrocarbons. The heavy hydrocarbon stream includes $C_{13}$ or higher circular hydrocarbons. The hydrotreater is fluidically coupled to the feed fractionator to receive the medium hydrocarbon stream and configured to desulfurize the medium hydrocarbon stream to produce a hydrotreated hydrocarbon stream. The medium hydrocarbon fractionator is fluidically coupled to the hydrotreater to receive the hydrotreated hydrocarbon stream and produce a first fractionated medium hydrocarbon stream including $C_6$ to $C_8$ circular hydrocarbons and a second fractionated medium hydrocarbon stream including $C_9$ to $C_{12}$ circular hydrocarbons. The catalytic reforming unit includes a zeolitic reforming catalyst comprising platinum on a bound zeolite support. The catalytic reforming unit is fluidically coupled to the medium hydrocarbon fractionator to receive the first fractionated medium stream and produce a first circular aromatic-rich stream. The full-range naphtha reforming unit includes a catalyst and is fluidically coupled to the medium hydrocarbon fractionator to receive the second fractionated medium stream and produce a second circular aromatic-rich stream. The heavy oil cracker is fluidically coupled to the feed fractionator to receive the heavy hydrocarbon stream and generate a first cracked stream including $C_6$ or higher circular hydrocarbons and a second cracked stream including $C_5$ or lower circular hydrocarbons. The steam cracker is fluidically coupled to the heavy oil cracker to receive the first cracked stream and produce a circular olefin stream.

In aspects according to the present disclosure, a process for producing chemicals or polymers from plastic waste includes fractionating a pyrolyzed plastics feed into a light hydrocarbon stream, a medium hydrocarbon stream, and a heavy hydrocarbon stream. The light hydrocarbon stream includes $C_5$ or lower circular hydrocarbons. The medium hydrocarbon stream includes $C_6$-$C_{12}$ circular hydrocarbons. The heavy hydrocarbon stream includes $C_{13}$ or higher circular hydrocarbons. The process further includes hydrotreating the medium hydrocarbon stream to desulfurize the medium hydrocarbon stream to produce a hydrotreated hydrocarbon stream. The process further includes fractionating the hydrotreated hydrocarbon stream to produce a first fractionated medium hydrocarbon stream including $C_6$ to $C_8$ hydrocarbons and a second fractionated medium hydrocarbon stream including $C_9$ to $C_{12}$ hydrocarbons. The process further includes catalytically reforming the first medium hydrocarbon stream over a zeolitic reforming catalyst comprising platinum on a bound zeolite support to produce a first circular aromatic-rich stream. The process further includes continuously catalytically reforming the second medium hydrocarbon stream over a catalyst to produce a second circular aromatic-rich stream. The process further includes cracking the heavy hydrocarbon stream to generate a first cracked stream including $C_6$ or higher circular hydrocarbons and a second cracked stream including $C_5$ or lower circular hydrocarbons. The process further includes steam cracking the first cracked stream to produce a circular olefin stream.

FIG. 1 is a conceptual block diagram of a system 10 for producing chemicals or polymers from plastic waste. The system 10 includes a feed line 12, a feed fractionator 14, a hydrotreater 16, a catalytic reforming unit 18, a heavy oil cracker 20, and a steam cracker 22. The feed line 12 includes a pyrolyzed plastics feed. The pyrolyzed plastics feed (also known as pyrolysis oil) is obtained by pyrolysis of waste plastics. The pyrolyzed plastics feed may be pre-processed, for example, to reduce or remove one or more contaminants. In some aspects, the pyrolyzed plastics feed is not pre-processed to reduce or remove contaminants. In some aspects, the pyrolyzed plastics feed further includes a naphtha feed. For example, the naphtha may be introduced to make up variations in supply of the pyrolyzed plastics feed.

The feed fractionator 14 is coupled to the feed line 12 for separating the pyrolyzed plastics feed into a light hydrocarbon stream 24, a medium hydrocarbon stream 26, and a heavy hydrocarbon stream 28. The light hydrocarbon stream 24 includes $C_5$ or lower circular hydrocarbons. The medium hydrocarbon stream 26 includes $C_6$-$C_8$ circular hydrocarbons. The heavy hydrocarbon stream 28 includes $C_9$ or higher circular hydrocarbons.

The hydrotreater 16 is fluidically coupled to the feed fractionator 14 to receive the medium hydrocarbon stream 26. The hydrotreater 16 is and configured to desulfurize the medium hydrocarbon stream 26 to produce a circular hydrotreated hydrocarbon stream 30. The desulfurization in the hydrotreater 16 also forms hydrogen sulfide ($H_2S$), which may be removed from the hydrotreater 16. A supply of hydrogen may be provided to the hydrotreater 16. The hydrogen may be a stream of fresh hydrogen introduced from outside the system 10, or may include a stream of recycled hydrogen from within the system 10, for example, hydrogen extracted or released from another component of the system 10.

The catalytic reforming unit 18 may include a suitable catalyst for reforming a hydrocarbon stream. For example, the catalytic reforming unit 18 may include a platinum-supporting zeolite catalyst. The catalytic reforming unit 18 is fluidically coupled to the hydrotreater 16 to receive the circular hydrotreated hydrocarbon stream 30 and produce a circular aromatic-rich stream 32.

In course of reforming, the catalytic reforming unit 18 may generate hydrogen. This hydrogen may be considered to be circular hydrogen as ultimately originating from the pyrolyzed plastics feed 12. In some aspects, the catalytic reforming unit 18 is configured to generate a circular hydrogen stream 40. Hydrogen from the hydrogen stream 40 may be sold as a circular product, sent to storage, or to a component of a different system, or to a different component of the system 10. For example, the hydrotreater 16 may be further fluidically coupled to the catalytic reforming unit 16, to receive the circular hydrogen stream 40. Thus, hydrogen generated by the catalytic reforming unit 18 may be utilized by other components of the system 10.

The heavy oil cracker 20 is fluidically coupled to the feed fractionator 14 to receive the heavy hydrocarbon stream 28 and generate a first cracked stream 34 including $C_6$ or higher circular hydrocarbons and a second cracked stream 36 including $C_5$ or lower circular hydrocarbons.

The steam cracker 22 is fluidically coupled to the heavy oil cracker 20 to receive the first cracked stream 36 and produce a circular olefin stream 38. In addition, the steam cracker 22 may receive a hydrocarbon stream from another component of the system 10, and may process hydrocarbons originating from various components or fractions. For example, the steam cracker 22 may be further fluidically coupled to the feed fractionator 14, and may receive the light hydrocarbon stream 24 from the feed fractionator 14.

In this way, the system 10 may process the pyrolyzed plastics feed introduced in feed inlet 12 into circular olefins (for example, an olefin in circular olefin stream 38) and circular aromatics (for example, an aromatic in circular aromatic-rich stream 32).

The olefins and aromatics may be present in certain fractions, and various streams produced by the system 10 may be further processed, for example, to product particular olefins or aromatics of interest. The system 10 may include further components to process one or more streams.

In aspects, the system 10 further includes an olefin fractionator 42 fluidically coupled to the steam cracker 22. The olefin fractionator 42 may fractionate the circular olefin stream 38 to separate one or more olefin streams. For example, the olefin fractionator 42 may receive the circular olefin stream 38 from the steam cracker 22, and produce one or more of a circular ethylene stream 44, a circular propylene stream 46, or a fractionated pyrolysis gasoline stream 48 including $C_6$ or higher circular hydrocarbons. One of more of these streams may be sent to storage, or further processed to form circular products. For example, the system 10 may further include a polymerization unit 50 or 52 configured to receive a fractionated circular olefin (for example, ethylene or propylene) from the olefin fractionator 42 and polymerize the fractionated circular olefin into a circular polyolefin. In some aspects, the polymerization unit 50 may be a ethylene polymerization unit that produces polyethylene from ethylene, and the system 10 may further include a propylene polymerization unit 52 that produces polypropylene from propylene. In some aspects, the system 10 includes a single polymerization unit that may generate a predetermined polyolefin from an appropriate olefin sourced from the system 10. The circular polyolefin may include a circular polyethylene or a circular polypropylene.

Aromatics produced by the system 10 may be further processed, for example, further fractionated. In aspects, the system 10 further includes a distillation unit 54 fluidically coupled to the catalytic reforming unit 18 to receive the circular aromatic-rich stream 32 and produce a light aromatics stream 56 including $C_6$ circular aromatics and a heavy aromatics stream 58 including $C_7$ circular aromatics or higher. The heavy aromatics stream 58 may be sent to storage or sold as a circular product. The light aromatics stream 56 may be sent to storage or sold as a circular product, or further processed to extract fractions or components of interest, such as benzene.

In aspects, the distillation unit 54 is configured to produce a fuel gas stream 60. Fuel gas from the fuel gas stream 60 may be sent to storage or sold as a circular product, or used within the system 10. For example, the steam cracker 22 may be further coupled to the distillation unit 54 to receive the fuel gas stream 60.

While the system 10 may include a single distillation unit (for example, the distillation unit 54), in other aspects, the system 10 may include further distillation units. For example, the distillation unit 54 may be a first distillation unit, and the system may further include an extractive distillation unit 62 fluidically coupled to the first distillation unit 54. The extractive distillation unit 62 may receive the light aromatics stream 56 and produce a circular benzene stream 64 and a raffinate stream 66. The raffinate stream 66 may include a substantially benzene-free fraction, and may be sent to storage or sold as a circular product, or used by another component of the system 10. For example, the steam cracker 22 may be further fluidically coupled to the extractive distillation unit 54 to receive the raffinate stream 66.

The circular benzene from the circular benzene stream 64 may be sent to storage or sold as a circular product, or may be further processed. For example, the system 10 may further include a hydrogenation unit 68 coupled to the extractive distillation unit 64. The hydrogenation unit 68 may be configured to catalytically hydrogenate the circular benzene from the circular benzene stream 64 to produce circular cyclohexane. In aspects, fresh hydrogen may be supplied to the hydrogen unit from outside the system 10. In some aspects, instead of, or in addition to, such external hydrogen, hydrogen from within the system 10 may be recycled to or supplied to the hydrogenation unit 68. For example, hydrogen from the hydrogen stream 40 generated by the catalytic reforming unit 18 may be supplied to the hydrogenation unit 68.

The circular benzene may also be combined with other components to generate further products. For example, one or more of ethylbenzene, styrene, or polystyrene may be produced from the circular benzene. In some such aspects, circular ethylene produced by the olefin fractionator 42 may be reacted with the circular benzene to produce such products. Instead of, or in addition to ethylene sourced from the system 10, the ethylene may be supplied from a source external to the system 10.

The fractionated pyrolysis gasoline stream 48 produced by the olefin fractionator 42 may be further used within the system 10. For example, the hydrotreater 16 may be a first hydrotreater, and the system 10 may further include a second hydrotreater 70. The second hydrotreater 70 may be fluidically coupled to the olefin fractionator 42 to receive the fractionated pyrolysis gasoline stream 48 and produce a treated pyrolysis gasoline stream 72. The distillation unit 54 may be further fluidically coupled to the second hydrotreater 70 to receive the treated pyrolysis gasoline stream 72. In this way, the system 10 may maximize circularization and reuse or conversion of various fractions of the pyrolyzed plastic feed introduced in the inlet 12.

Thus, the system 10 may be used to produce various circular chemicals, monomers, or polymers from a pyrolyzed plastics feed. The system 10 may be operated according to any suitable processes.

Figure 2:
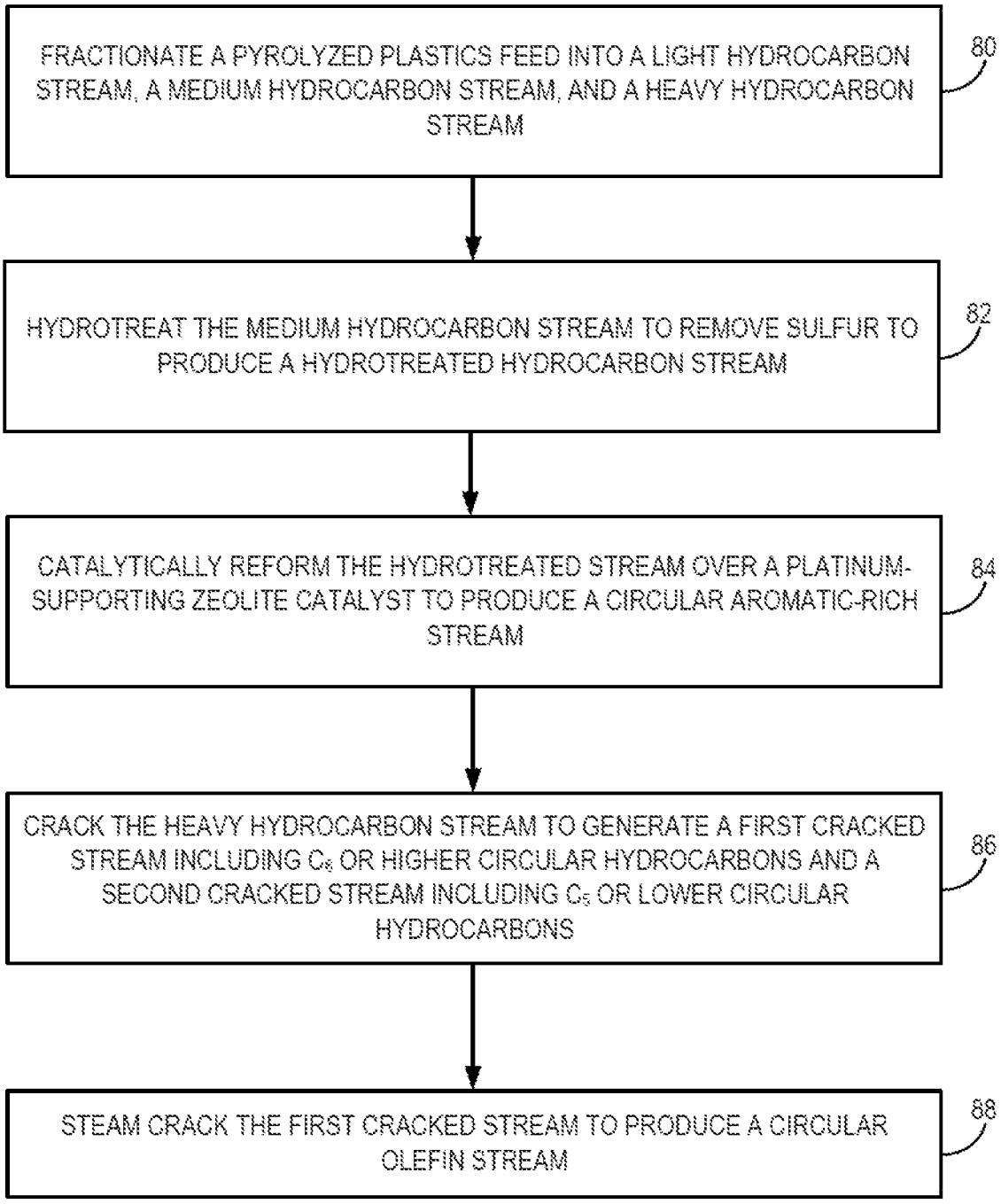
FIG. 2 is a flow diagram of a process for producing chemicals or polymers from plastic waste.

FIG. 2 is a flow diagram of a process for producing chemicals or polymers from plastic waste. The process of FIG. 2 described, as an example, with reference to system 10. However, the process of FIG. 2 may be performed using any suitable system.

The process of FIG. 2 includes fractionating a pyrolyzed plastics feed (for example, from a feed inlet 12) into the light hydrocarbon stream 24, the medium hydrocarbon stream 26, and the heavy hydrocarbon stream 28 (80). The light hydrocarbon stream includes $C_5$ or lower circular hydrocarbons. The medium hydrocarbon stream includes $C_6$-$C_8$ circular hydrocarbons. The heavy hydrocarbon stream includes $C_9$ or higher circular hydrocarbons. The fractionating (80) may be performed using the feed fractionator 14. In some aspects, the process of FIG. 2 further includes adding a naphtha stream to the pyrolyzed plastics feed, for example, prior to the fractionating (82).

The process of FIG. 2 may further include hydrotreating the medium hydrocarbon stream 26 to desulfurize the medium hydrocarbon stream to produce the hydrotreated hydrocarbon stream 30 (82). The hydrotreating (82) may be performed using the hydrotreater 16.

The process of FIG. 2 may further include catalytically reforming the hydrotreated stream 30 over a zeolitic reforming catalyst comprising platinum on a bound zeolite support (for example, in the catalytic reforming unit 18) to produce a circular aromatic-rich stream 32 (84). In some aspects, the catalytic reforming of the hydrotreated stream (84) produces the circular hydrogen stream 40, and the process further includes recycling a portion of the circular hydrogen stream 40 as a hydrogen source for the hydrotreating (82) of the medium hydrocarbon stream.

The process of FIG. 2 may further include cracking the heavy hydrocarbon stream 28 (for example, obtained from the feed fractionator 14) (86) to generate the first cracked stream 34 including $C_6$ or higher circular hydrocarbons and the second cracked stream 36 including $C_5$ or lower circular hydrocarbons. The cracking (86) may be performed using the heavy oil cracker 20.

The process of FIG. 2 may further include steam cracking the first cracked stream 34 (for example, from the heavy oil cracker 20) to produce a circular olefin stream 38 (88). The steam cracking (88) may be performed using the steam cracker 22. The first cracked stream 34 (for example, from the heavy oil cracker 20) may be combined with the light hydrocarbon stream 24 (for example, from the feed fractionator 14) before the steam cracking (88).

The process of FIG. 2 may further include fractionating the circular olefin stream 38 (for example, using the olefin fractionator 42) to produce one or more of the circular ethylene stream(s) 44, the circular propylene stream 46, or the fractionated pyrolysis gasoline stream 48 including $C_6$ or higher circular hydrocarbons. In some such aspects, the process further includes a second hydrotreating step of the fractionated pyrolysis gasoline stream 48 to produce the treated pyrolysis gasoline stream 72. The treated pyrolysis gasoline stream 72 may be used as a co-feed in a distilling step, for example, in the distillation unit 54.

The process of FIG. 2 may further include processing or reacting one or more components produced by one or more steps of the process. For example, the process may further include polymerizing a circular olefin from a circular olefin stream (for example, one of streams 44 or 46) into a circular polyolefin. In aspects, the circular polyolefin includes a circular polyethylene or a circular polypropylene. In aspects, the process further includes catalytically hydrogenating circular benzene from the circular benzene stream 64 to produce circular cyclohexane.

The process of FIG. 2 may further include distilling the circular aromatic-rich stream 48 to produce the light aromatics stream 56 including $C_6$ circular aromatics and the heavy aromatics stream 58 including $C_7$ circular aromatics or higher. The distilling may be performed in the distillation unit 54. The distilling may produce the fuel gas stream 60. In some such aspects, the process further includes using the fuel gas stream 60 as a co-feed in the steam cracking (88), for example, in the steam cracker 22.

Further distillation(s) may be performed. For example, the process of FIG. 2 may further include extractive distillation of the light aromatics stream 56 to produce the circular benzene stream 64 and the raffinate stream 66. The raffinate stream 66 may further be combined with the first cracked stream 24 (for example, from the feed fractionator 14) before the steam cracking (88).

Thus, processes according to the present disclosure may be used to prepare various circular chemicals, monomers, and polymers from a pyrolyzed plastics feed.

The present disclosure also provides alternative or modified systems and processes for producing circular chemicals, monomers, and polymers from a pyrolyzed plastics feed. Where appropriate, like components are numbered alike. It will be understood that similar components in these alternative or modified systems or processes may perform similar functions as described elsewhere herein.

Figure 3:
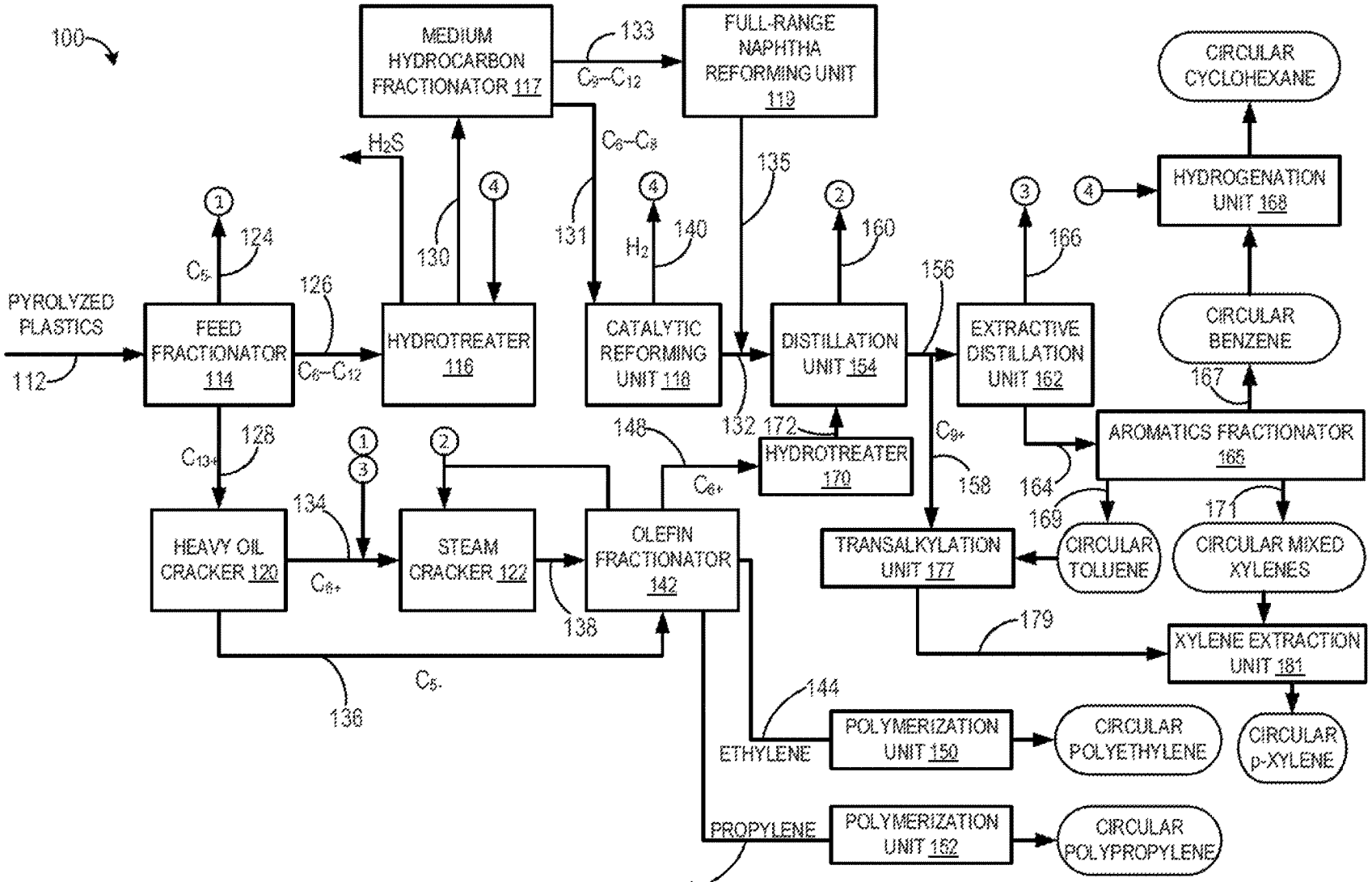
FIG. 3 is a conceptual block diagram of a system for producing chemicals or polymers from plastic waste.

FIG. 3 is a conceptual block diagram of a system 100 for producing chemicals or polymers from plastic waste. The system 100 includes a feed line 112, a feed fractionator 114, a hydrotreater 116, a medium hydrocarbon fractionator 117, a catalytic reforming unit 118, a full-range naphtha reforming unit 119, a heavy oil cracker 120, and a steam cracker 122.

The pyrolyzed plastics feed introduced in feed line 112 may further include a naphtha feed.

The feed line 112, the feed fractionator 114, the hydrotreater 116, the catalytic reforming unit 118, the heavy oil cracker 120, and the steam cracker 122 are respectively similar to the feed line 12, the feed fractionator 14, the hydrotreater 16, the catalytic reforming unit 18, the heavy oil cracker 20, and the steam cracker 22 described with reference to FIG. 1. However, the feed fractionator 114 fractionates the pyrolyzed plastics feed into different fractions. In particular, the feed fractionator 114 separates the pyrolyzed plastics feed into a light hydrocarbon stream 124, a medium hydrocarbon stream 126, and a heavy hydrocarbon stream 128. The light hydrocarbon stream 124 includes $C_5$ or lower circular hydrocarbons. The medium hydrocarbon stream 126 includes $C_6$-$C_{12}$ circular hydrocarbons. The heavy hydrocarbon stream 128 includes $C_{13}$ or higher circular hydrocarbons.

The hydrotreater 116 is fluidically coupled to the feed fractionator 114 to receive the medium hydrocarbon stream 126 and configured to desulfurize the medium hydrocarbon stream to produce a hydrotreated hydrocarbon stream 130.

The medium hydrocarbon fractionator 117 is fluidically coupled to the hydrotreater 116 to receive the hydrotreated hydrocarbon stream 130 and produce a first fractionated medium hydrocarbon stream 131 including $C_6$ to $C_5$ circular hydrocarbons and a second fractionated medium hydrocarbon stream 133 including $C_9$ to $C_{12}$ circular hydrocarbons.

The catalytic reforming unit 118 is fluidically coupled to the medium hydrocarbon fractionator 117 to receive the first fractionated medium stream 131 and produce a first circular aromatic-rich stream 132. The catalytic reforming unit 118 may be configured to generate a circular hydrogen stream 140. The hydrotreater 116 may be further fluidically coupled to the catalytic reforming unit 118 to receive the circular hydrogen stream 140.

The full-range naphtha reforming unit 119 includes a catalyst and is fluidically coupled to the medium hydrocarbon fractionator 117 to receive the second fractionated medium stream 133 and produce a second circular aromatic-rich stream 135. In some aspects, the catalyst in the full-range naphtha reforming unit 119 includes platinum on an alumina catalyst support, and may optionally include chloride and/or stannide. The catalyst may include a platinum zeolite catalyst. The catalyst may include a reforming catalyst from Honeywell UOP (Charlotte, North Carolina), for example, R-234™ catalyst, R-254™ catalyst, R-264™ catalyst, R-334™ catalyst, R-364™ catalyst, R-464™ catalyst, or RMY-7™ catalyst.

The heavy oil cracker 120 is fluidically coupled to the feed fractionator 114 to receive the heavy hydrocarbon stream 128 and generate a first cracked stream 134 including $C_6$ or higher circular hydrocarbons and a second cracked stream including $C_5$ or lower circular hydrocarbons.

The steam cracker 122 is fluidically coupled to the heavy oil cracker 120 to receive the first cracked stream 134 and produce a circular olefin stream 138. In some aspects, the steam cracker 122 is further fluidically coupled to the feed fractionator 114 to receive the light hydrocarbon stream 124.

The system 100 may further include an olefin fractionator 142 fluidically coupled to the steam cracker 122 to receive the circular olefin stream 138 and produce one or more of a circular ethylene stream 144, a circular propylene stream 146, or a fractionated pyrolysis gasoline stream 148 including $C_6$ or higher circular hydrocarbons.

The system 100 may include polymerization units 150 or optionally 152 configured to receive a fractionated circular olefin from the olefin fractionator 142 and polymerize the fractionated circular olefin into a circular polyolefin. The circular polyolefin may include polyethylene (unit 150) or polypropylene (unit 152). The system 100 may include a second polymerization unit 152, with the respective polymerization units producing respective circular polyolefins.

The system 100 may further include a distillation unit 154 fluidically coupled to the catalytic reforming unit 118 and to the full-range naphtha reforming unit 119 to receive the first circular aromatic-rich stream 132 and the second aromatic-rich stream 135 and produce a light aromatics stream 156 including $C_6$ to $C_5$ circular aromatics and a heavy aromatics stream 158 including $C_9$ circular aromatics or higher. The distillation unit 154 may be configured to produce a fuel gas stream 160. In aspects, the steam cracker 122 is further coupled to the distillation unit 154 to receive the fuel gas stream 160.

In aspects, the distillation unit 154 is a first distillation unit, and the system 100 further includes an extractive distillation unit 162 fluidically coupled to the first distillation unit 154 to receive the light aromatics stream 156 and produce a circular aromatics stream 164 and a raffinate stream 166. The circular aromatics stream may include benzene or other aromatics. In some such aspects, the steam cracker 122 is further fluidically coupled to the extractive distillation unit 162 to receive the raffinate stream 166.

In some aspects, the hydrotreater 116 is a first hydrotreater, and the system 100 includes a second hydrotreater 170 fluidically coupled to the olefin fractionator 142 to receive the fractionated pyrolysis gasoline stream 148 and produce a treated pyrolysis gasoline stream 172. The distillation unit 154 may be further fluidically coupled to the second hydrotreater 170 to receive the treated pyrolysis gasoline stream 172.

In aspects, the system 100 further includes an aromatics fractionator 165 fluidically coupled to the extractive distillation unit 162 to receive the circular aromatics stream 164 and produce one or more of a circular benzene stream 167, a circular toluene stream 169, and a circular mixed xylenes stream 171.

In aspects, the system further includes a hydrogenation unit 168 coupled to the extractive distillation unit 162 (for example, via the aromatics fractionator 165, or by an additional or alternative direct coupling). The hydrogenation unit 168 is configured to catalytically hydrogenate circular benzene from the circular benzene stream 164 to produce circular cyclohexane.

The system 100 may further include a transalkylation unit 177 fluidically coupled to the distillation unit 154 to receive the heavy aromatics stream 158 and to the aromatics fractionator 165 to receive the circular toluene stream 169, and configured to produce a mixed xylene stream 179 including at least circular para-xylene.

The mixed xylene stream 179 may be further processed, for example, in a xylene extraction unit 181, to extract a particular xylene of interest. In some aspects, the xylene extraction unit 181 is configured to extract para-xylene from the mixed xylene stream 179.

Thus, the system 100 may be used to produce one or more olefin or aromatic compounds from the pyrolyzed plastics feed. Olefin or aromatic monomers may be further polymerized to produce circular polymers. Thus, the system 100 may be used to produce various circular chemicals, monomers, or polymers from a pyrolyzed plastics feed. The system 100 may be operated according to any suitable processes.

Figure 4:
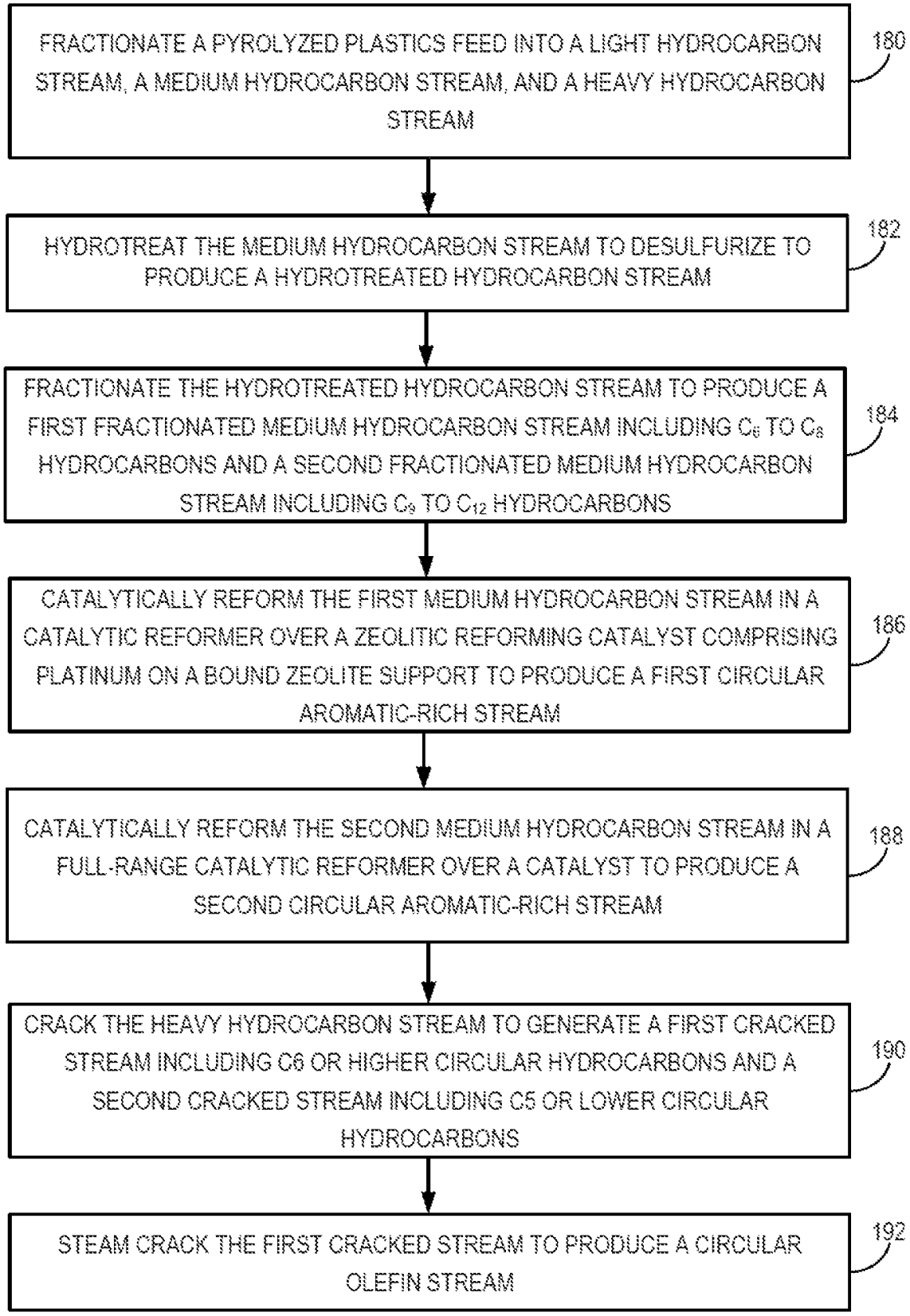
FIG. 4 is a flow diagram of a process for producing chemicals or polymers from plastic waste.

FIG. 4 is a flow diagram of a process for producing chemicals or polymers from plastic waste. The steps of the process of FIG. 4 are described, as an example, with reference to the system 100 of FIG. 3. However, the process of FIG. 4 may be performed using any suitable system.

The process of FIG. 4 includes fractionating a pyrolyzed plastics feed into the light hydrocarbon stream 124, the medium hydrocarbon stream 126, and the heavy hydrocarbon stream 128 (180). The light hydrocarbon stream 124 includes $C_5$ or lower circular hydrocarbons. The medium hydrocarbon stream 126 includes $C_6$-$C_{12}$ circular hydrocarbons. The heavy hydrocarbon stream 128 includes $C_{13}$ or higher circular hydrocarbons. The process may further include adding a naphtha stream to the pyrolyzed plastics feed, for example, introduced in the feed line 112.

The process of FIG. 4 may further include hydrotreating the medium hydrocarbon stream 126 to desulfurize the medium hydrocarbon stream to produce the hydrotreated hydrocarbon stream 130 (182). The hydrotreating (182) may be performed in the hydrotreater 116.

The process of FIG. 4 may further include fractionating the hydrotreated hydrocarbon stream 130 (184) to produce the first fractionated medium hydrocarbon stream 131 including $C_6$ to $C_5$ hydrocarbons and the second fractionated medium hydrocarbon 133 stream including $C_9$ to $C_{12}$ hydrocarbons. The fractionating (184) may be performed using the fractionator 117.

The process of FIG. 4 further includes catalytic reforming the first medium hydrocarbon stream 131 over a zeolitic reforming catalyst comprising platinum on a bound zeolite support (for example, in the catalytic reforming unit 118) to produce the first circular aromatic-rich stream 132 (186). In aspects, the catalytically reforming (186) the hydrotreated stream 130 produces the circular hydrogen stream 140, and the process may further include recycling a portion of the circular hydrogen stream 140 as a hydrogen source for the hydrotreating (182) the medium hydrocarbon stream 126.

The process of FIG. 4 may further include catalytically reforming the second medium hydrocarbon stream 133 over a catalyst (for example, in the full-range naphtha reforming unit 119) to produce the second circular aromatic-rich stream 135 (188).

The process of FIG. 4 may further include cracking the heavy hydrocarbon stream 128 to generate the first cracked stream 134 including $C_6$ or higher circular hydrocarbons and the second cracked stream 136 including $C_5$ or lower circular hydrocarbons (190). The cracking (190) may be performed in the heavy oil cracker 120.

The process of FIG. 4 may further include steam cracking the first cracked stream 134 to produce the circular olefin stream 138 (192). The steam cracking may be performed in the steam cracker 122. In some aspects, the first cracked stream 134 may be combined with the light hydrocarbon stream 124 (for example, from the feed fractionator 114) before the steam cracking (192).

The process of FIG. 4 may further include 47 fractionating the circular olefin stream 138 to produce one or more of the circular ethylene stream(s) 144, the circular propylene stream 146, or the fractionated pyrolysis gasoline stream 148 including $C_6$ or higher circular hydrocarbons. The fractionating may be performed in the olefin fractionator 142. One or more circular olefins may be polymerized. For example, the process may further include polymerizing a circular olefin from the circular olefin stream 138 into a circular polyolefin. The circular polyolefin includes a circular polyethylene or a circular polypropylene.

The process of FIG. 4 may further include distilling (for example, using the distillation unit 154) a combination of the first circular aromatic-rich stream 132 (for example, from the catalytic reforming unit 118) and the second circular aromatic-rich stream 135 (for example, from the full-range naphtha reforming unit 119) to produce the light aromatics stream 156 including $C_6$ to $C_5$ circular aromatics and the heavy aromatics stream 158 including Co circular aromatics or higher. In some aspects, the distilling produces the fuel gas stream 160. The fuel gas stream 160 may be used as a co-feed in the steam cracking (192). In some aspects, the fractionating the circular olefin stream produces fuel gas, and the process may further include combining the fuel gas with the first cracked stream 134 before the steam cracking (192).

The process of FIG. 4 may further include extractive distillation of the light aromatics stream 156 to produce the circular aromatics stream 164 and the raffinate stream 166. The extractive distillation may be performed in the extractive distillation unit 162. The raffinate stream 166 may be combined with the first cracked stream 124 before the steam cracking (192).

The process of FIG. 4 may further include a second hydrotreating step of the fractionated pyrolysis gasoline stream 148 to produce the treated pyrolysis gasoline stream 172. The treated pyrolysis gasoline stream 172 may be used as a co-feed in the distilling step (for example, using the distillation unit 154).

The process of FIG. 4 may further include fractionating the circular aromatics stream 164 to produce one or more of the circular benzene stream(s) 167, the circular toluene stream 169, or the circular mixed xylenes stream 171. The fractionating may be performed using the aromatics fractionator 165. The circular benzene from the circular benzene stream 167 may be catalytically hydrogenated to produce circular cyclohexane, for example, using the hydrogenation unit 168.

The process of FIG. 4 may further include transalkylating the heavy aromatics stream 158 and the circular toluene stream 169 to produce the mixed xylene stream 179 including at least circular para-xylene.

The disclosure is described above with reference to numerous aspects and embodiments, and specific examples. Many variations will suggest themselves to those skilled in the art in light of the above detailed description. All such obvious variations are within the full intended scope of the appended claims. Other aspects of the disclosure can include, but are not limited to, the following aspects. Many aspects are described as "comprising" certain components or steps, but alternatively, can "consist essentially of" or "consist of" those components or steps unless specifically stated otherwise.

ASPECTS OF THE DISCLOSURE

Aspect 1. A system for producing chemicals or polymers from plastic waste, the system including:

a feed line including a pyrolyzed plastics feed;

a feed fractionator coupled to the feed line for separating the pyrolyzed plastics feed into a light hydrocarbon stream, a medium hydrocarbon stream, and a heavy hydrocarbon stream, where the light hydrocarbon stream includes $C_5$ or lower circular hydrocarbons, where the medium hydrocarbon stream includes $C_6$-$C_8$ circular hydrocarbons, and where the heavy hydrocarbon stream includes $C_9$ or higher circular hydrocarbons;

a hydrotreater fluidically coupled to the feed fractionator to receive the medium hydrocarbon stream and configured to desulfurize the medium hydrocarbon stream to produce a circular hydrotreated hydrocarbon stream;

a catalytic reforming unit including a platinum-supporting zeolite catalyst, where the catalytic reforming unit is fluidically coupled to the hydrotreater to receive the circular hydrotreated hydrocarbon stream and produce a circular aromatic-rich stream;

a heavy oil cracker fluidically coupled to the feed fractionator to receive the heavy hydrocarbon stream and generate a first cracked stream including $C_6$ or higher circular hydrocarbons and a second cracked stream including $C_5$ or lower circular hydrocarbons; and a steam cracker fluidically coupled to the heavy oil cracker to receive the first cracked stream and produce a circular olefin stream.

Aspect 2. The system of aspect 1, where the pyrolyzed plastics feed further includes a naphtha feed.

Aspect 3. The system of aspects 1 or 2, where the catalytic reforming unit is configured to generate a circular hydrogen stream, and where the hydrotreater is further fluidically coupled to the catalytic reforming unit to receive the circular hydrogen stream.

Aspect 4. The system of any of aspects 1 to 3, where the steam cracker is further fluidically coupled to the feed fractionator to receive the light hydrocarbon stream.

Aspect 5. The system of any of aspects 1 to 4, further including an olefin fractionator fluidically coupled to the steam cracker to receive the circular olefin stream and produce one or more of a circular ethylene stream, a circular propylene stream, or a fractionated pyrolysis gasoline stream including $C_6$ or higher circular hydrocarbons.

Aspect 6. The system of aspect 5, further including a polymerization unit configured to receive a fractionated circular olefin from the olefin fractionator and polymerize the fractionated circular olefin into a circular polyolefin.

Aspect 7. The system of aspect 6, where the circular polyolefin includes a circular polyethylene or a circular polypropylene.

Aspect 8. The system of any of aspects 1 to 7, further including a distillation unit fluidically coupled to the catalytic reforming unit to receive the circular aromatic-rich stream and produce a light aromatics stream including $C_6$ circular aromatics and a heavy aromatics stream including $C_7$ circular aromatics or higher.

Aspect 9. The system of aspect 8, where the distillation unit is configured to produce a fuel gas stream, and where the steam cracker is further coupled to the distillation unit to receive the fuel gas stream.

Aspect 10. The system of aspects 8 or 9, where the distillation unit is a first distillation unit, the system further including an extractive distillation unit fluidically coupled to the first distillation unit to receive the light aromatics stream and produce a circular benzene stream and a raffinate stream.

Aspect 11. The system of aspect 10, where the steam cracker is further fluidically coupled to the extractive distillation unit to receive the raffinate stream.

Aspect 12. The system of aspects 10 or 11, further including a hydrogenation unit coupled to the extractive distillation unit, where the hydrogenation unit is configured to catalytically hydrogenate circular benzene from the circular benzene stream to produce circular cyclohexane.

Aspect 13. The system of any of aspects 5 to 12, where the hydrotreater is a first hydrotreater, the system further including a second hydrotreater fluidically coupled to the olefin fractionator to receive the fractionated pyrolysis gasoline stream and produce a treated pyrolysis gasoline stream, and where the distillation unit is further fluidically coupled to the second hydrotreater to receive the treated pyrolysis gasoline stream.

Aspect 14. A process for producing chemicals or polymers from plastic waste, the process including:

fractionating a pyrolyzed plastics feed into a light hydrocarbon stream, a medium hydrocarbon stream, and a heavy hydrocarbon stream, where the light hydrocarbon stream includes $C_5$ or lower circular hydrocarbons, where the medium hydrocarbon stream includes $C_6$-$C_8$ circular hydrocarbons, and where the heavy hydrocarbon stream includes $C_9$ or higher circular hydrocarbons;

hydrotreating the medium hydrocarbon stream to desulfurize the medium hydrocarbon stream to produce a hydrotreated hydrocarbon stream;

catalytically reforming the hydrotreated stream over a zeolitic reforming catalyst comprising platinum on a bound zeolite support to produce a circular aromatic-rich stream;

cracking the heavy hydrocarbon stream to generate a first cracked stream including $C_6$ or higher circular hydrocarbons and a second cracked stream including $C_5$ or lower circular hydrocarbons; and steam cracking the first cracked stream to produce a circular olefin stream.

Aspect 15. The process of aspect 14, further including adding a naphtha stream to the pyrolyzed plastics feed.

Aspect 16. The process of aspects 14 or 15, where the catalytically reforming the hydrotreated stream produces a circular hydrogen stream, further including recycling a portion of the circular hydrogen stream as a hydrogen source for the hydrotreating the medium hydrocarbon stream.

Aspect 17. The process of any of aspects 14 to 16, further including combining the first cracked stream with the light hydrocarbon stream before the steam cracking.

Aspect 18. The process of any of aspects 14 to 17, further including fractionating the circular olefin stream to produce one or more of a circular ethylene stream, a circular propylene stream, or a fractionated pyrolysis gasoline stream including $C_6$ or higher circular hydrocarbons.

Aspect 19. The process of aspect 18, further including polymerizing a circular olefin from the circular olefin stream into a circular polyolefin.

Aspect 20. The process of aspect 19, where the circular polyolefin includes a circular polyethylene or a circular polypropylene.

Aspect 21. The process of any of aspects 14 to 20, further including distilling the circular aromatic-rich stream to produce a light aromatics stream including $C_6$ circular aromatics and a heavy aromatics stream including $C_7$ circular aromatics or higher.

Aspect 22. The process of aspect 21, where the distilling produces a fuel gas stream, further including using the fuel gas stream as a co-feed in the steam cracking.

Aspect 23. The process of aspects 21 or 22, further including extractive distillation of the light aromatics stream to produce a circular benzene stream and a raffinate stream.

Aspect 24. The process of aspect 23, further including combining the raffinate stream with the first cracked stream before the steam cracking.

Aspect 25. The process of aspects 23 or 24, further including catalytically hydrogenating circular benzene from the circular benzene stream to produce circular cyclohexane.

Aspect 26. The process of any of aspects 21 to 25, further including a second hydrotreating step of the fractionated pyrolysis gasoline stream to produce a treated pyrolysis gasoline stream, and where the treated pyrolysis gasoline stream is used as a co-feed in the distilling step.

Aspect 27. A system for producing chemicals or polymers from plastic waste, the system including:

a feed line including a pyrolyzed plastics feed;

a feed fractionator coupled to the feed line for separating the pyrolyzed plastics feed into a light hydrocarbon stream, a medium hydrocarbon stream, and a heavy hydrocarbon stream, where the light hydrocarbon stream includes $C_5$ or lower circular hydrocarbons, where the medium hydrocarbon stream includes $C_6$-$C_{12}$ circular hydrocarbons, and where the heavy hydrocarbon stream includes $C_{13}$ or higher circular hydrocarbons;

a hydrotreater fluidically coupled to the feed fractionator to receive the medium hydrocarbon stream and configured to desulfurize the medium hydrocarbon stream to produce a hydrotreated hydrocarbon stream;

a medium hydrocarbon fractionator fluidically coupled to the hydrotreater to receive the hydrotreated hydrocarbon stream and produce a first fractionated medium hydrocarbon stream including $C_6$ to $C_8$ circular hydrocarbons and a second fractionated medium hydrocarbon stream including $C_9$ to $C_{12}$ circular hydrocarbons;

a catalytic reforming unit including a platinum-supporting zeolite catalyst, where the catalytic reforming unit is fluidically coupled to the medium hydrocarbon fractionator to receive the first fractionated medium stream and produce a first circular aromatic-rich stream;

full-range naphtha reforming unit including a catalyst, where the full-range naphtha reforming unit is fluidically coupled to the medium hydrocarbon fractionator to receive the second fractionated medium stream and produce a second circular aromatic-rich stream, a heavy oil cracker fluidically coupled to the feed fractionator to receive the heavy hydrocarbon stream and generate a first cracked stream including $C_6$ or higher circular hydrocarbons and a second cracked stream including $C_5$ or lower circular hydrocarbons; and a steam cracker fluidically coupled to the heavy oil cracker to receive the first cracked stream and produce a circular olefin stream.

Aspect 28. The system of aspect 27, where the catalyst in the full-range naphtha reforming unit includes platinum on an alumina catalyst support.

Aspect 29. The system of aspects 27 or 28, where the pyrolyzed plastics feed further includes a naphtha feed.

Aspect 30. The system of any of aspects 27 to 29, where the catalytic reforming unit is configured to generate a circular hydrogen stream, and where the hydrotreater is further fluidically coupled to the catalytic reforming unit to receive the circular hydrogen stream.

Aspect 31. The system of any of aspects 27 to 30, where the steam cracker is further fluidically coupled to the feed fractionator to receive the light hydrocarbon stream.

Aspect 32. The system of any of aspects 27 to 31, further including an olefin fractionator fluidically coupled to the steam cracker to receive the circular olefin stream and produce one or more of a circular ethylene stream, a circular propylene stream, or a fractionated pyrolysis gasoline stream including $C_6$ or higher circular hydrocarbons.

Aspect 33. The system of aspect 32, further including a polymerization unit configured to receive a fractionated circular olefin from the olefin fractionator and polymerize the fractionated circular olefin into a circular polyolefin.

Aspect 34. The system of aspect 33, where the circular polyolefin includes polyethylene or polypropylene.

Aspect 35. The system of any of aspects 27 to 34, further including a distillation unit fluidically coupled to the catalytic reforming unit and to the full-range naphtha reforming unit to receive the first circular aromatic-rich stream and the second aromatic-rich stream and produce a light aromatics stream including $C_6$ to $C_8$ circular aromatics and a heavy aromatics stream including $C_9$ circular aromatics or higher.

Aspect 36. The system of aspect 35, where the distillation unit is configured to produce a fuel gas stream, and where the steam cracker is further coupled to the distillation unit to receive the fuel gas stream.

Aspect 37. The system of aspects 35 or 36, where the distillation unit is a first distillation unit, the system further including an extractive distillation unit fluidically coupled to the first distillation unit to receive the light aromatics stream and produce a circular aromatics stream and a raffinate stream.

Aspect 38. The system of aspect 37, where the steam cracker is further fluidically coupled to the extractive distillation unit to receive the raffinate stream.

Aspect 39. The system of any of aspects 32 to 38, where the hydrotreater is a first hydrotreater, and where the system further includes a second hydrotreater fluidically coupled to the olefin fractionator to receive the fractionated pyrolysis gasoline stream and produce a treated pyrolysis gasoline stream, and where the distillation unit is further fluidically coupled to the second hydrotreater to receive the treated pyrolysis gasoline stream.

Aspect 40. The system of any of aspects 37 to 39, further including an aromatics fractionator fluidically coupled to the extractive distillation unit to receive the circular aromatics stream and produce one or more of a circular benzene stream, a circular toluene stream, and a circular mixed xylenes stream.

Aspect 41. The system of aspect 40, further including a hydrogenation unit coupled to the extractive distillation unit, where the hydrogenation unit is configured to catalytically hydrogenate circular benzene from the circular benzene stream to produce circular cyclohexane.

Aspect 42. The system of aspect 41, further including a transalkylation unit fluidically coupled to the distillation unit to receive the heavy aromatics stream and to the aromatics fractionator to receive the circular toluene stream, and configured to produce a mixed xylene stream including at least circular para-xylene.

Aspect 43. A process for producing chemicals or polymers from plastic waste, the process including:

fractionating a pyrolyzed plastics feed into a light hydrocarbon stream, a medium hydrocarbon stream, and a heavy hydrocarbon stream, where the light hydrocarbon stream includes $C_5$ or lower circular hydrocarbons, where the medium hydrocarbon stream includes $C_6$-$C_{12}$ circular hydrocarbons, and where the heavy hydrocarbon stream includes $C_{13}$ or higher circular hydrocarbons;

hydrotreating the medium hydrocarbon stream to desulfurize the medium hydrocarbon stream to produce a hydrotreated hydrocarbon stream;

fractionating the hydrotreated hydrocarbon stream to produce a first fractionated medium hydrocarbon stream including $C_6$ to $C_5$ hydrocarbons and a second fractionated medium hydrocarbon stream including $C_9$ to $C_{12}$ hydrocarbons;

catalytically reforming the first medium hydrocarbon stream over a zeolitic reforming catalyst comprising platinum on a bound zeolite support to produce a first circular aromatic-rich stream;

continuously catalytically reforming the second medium hydrocarbon stream over a catalyst to produce a second circular aromatic-rich stream;

cracking the heavy hydrocarbon stream to generate a first cracked stream including $C_6$ or higher circular hydrocarbons and a second cracked stream including $C_5$ or lower circular hydrocarbons; and steam cracking the first cracked stream to produce a circular olefin stream.

Aspect 44. The process of aspect 43, where the catalyst in the full-range naphtha reforming unit includes platinum on an alumina catalyst support.

Aspect 45. The process of aspects 43 or 44, further including adding a naphtha stream to the pyrolyzed plastics feed.

Aspect 46. The process of any of aspects 43 to 45, where the catalytically reforming the hydrotreated stream produces a circular hydrogen stream, further including recycling a portion of the circular hydrogen stream as a hydrogen source for the hydrotreating the medium hydrocarbon stream.

Aspect 47. The process of any of aspects 43 to 46, further including combining the first cracked stream with the light hydrocarbon stream before the steam cracking.

Aspect 48. The process of any of aspects 43 to 47, further including fractionating the circular olefin stream to produce one or more of a circular ethylene stream, a circular propylene stream, or a fractionated pyrolysis gasoline stream including $C_6$ or higher circular hydrocarbons.

Aspect 49. The process of aspect 48, further including polymerizing a circular olefin from the circular olefin stream into a circular polyolefin.

Aspect 50. The process of aspect 49, where the circular polyolefin includes a circular polyethylene or a circular polypropylene.

Aspect 51. The process of any of aspects 43 to 50, further including distilling a combination of the first circular aromatic-rich stream and the second circular aromatic-rich stream to produce a light aromatics stream including $C_6$ to $C_8$ circular aromatics and a heavy aromatics stream including $C_9$ circular aromatics or higher.

Aspect 52. The process of aspect 51, where the distilling produces a fuel gas stream, further including using the fuel gas stream as a co-feed in the steam cracking.

Aspect 53. The process of aspects 51 or 52, further including extractive distillation of the light aromatics stream to produce a circular aromatics stream and a raffinate stream.

Aspect 54. The process of aspect 53, further including combining the raffinate stream with the first cracked stream before the steam cracking.

Aspect 55. The process of any of aspects 51 to 54, further including a second hydrotreating step of the fractionated pyrolysis gasoline stream to produce a treated pyrolysis gasoline stream, and where the treated pyrolysis gasoline stream is used as a co-feed in the distilling step.

Aspect 56. The process of any of aspects 53 to 55, further including fractionating the circular aromatics stream to produce one or more of a circular benzene stream, a circular toluene stream, and a circular mixed xylenes stream.

Aspect 57. The process of aspect 56, further including catalytically hydrogenating circular benzene from the circular benzene stream to produce circular cyclohexane.

Aspect 58. The process of aspects 56 or 57, further including transalkylating the heavy aromatics stream and the circular toluene stream to produce a mixed xylene stream including at least circular para-xylene.

Aspect 59. The process of any of aspects 48 to 58, where the fractionating the circular olefin stream produces fuel gas, further including combining the fuel gas with the first cracked stream before the steam cracking.

We claim:

1. A system for producing chemicals or polymers from plastic waste, the system comprising:

a feed line comprising a pyrolyzed plastics feed;

a feed fractionator coupled to the feed line for separating the pyrolyzed plastics feed into a light hydrocarbon stream, a medium hydrocarbon stream, and a heavy hydrocarbon stream, wherein the light hydrocarbon stream comprises $C_5$ or lower circular hydrocarbons, wherein the medium hydrocarbon stream comprises at least $C_6$-$C_8$ circular hydrocarbons, and wherein the heavy hydrocarbon stream comprises at least $C_{13}$ or higher circular hydrocarbons;

a hydrotreater fluidically coupled to the feed fractionator to receive the medium hydrocarbon stream and configured to desulfurize the medium hydrocarbon stream to produce a hydrotreated hydrocarbon stream comprising hydrotreated $C_6$-$C_8$ hydrocarbons;

a catalytic reforming unit comprising a platinum-supporting zeolite catalyst, wherein the catalytic reforming unit is fluidically coupled to the hydrotreater to receive the hydrotreated $C_6$-$C_8$ hydrocarbons and produce a first circular aromatic-rich stream;

a first distillation unit fluidically coupled to the catalytic reforming unit to receive the first circular aromatic-rich stream and produce a light aromatics stream comprising $C_6$ circular aromatics and a heavy aromatics stream comprising $C_7$ circular aromatics or higher;

an extractive distillation unit fluidically coupled to the first distillation unit to receive the light aromatics stream and produce a circular aromatics stream and a raffinate stream;

an aromatics fractionator fluidically coupled to the extractive distillation unit to receive the circular aromatics stream and produce one or more of a circular benzene stream, a circular toluene stream, and a circular mixed xylenes stream;

a heavy oil cracker fluidically coupled to the feed fractionator to receive the heavy hydrocarbon stream and generate a first cracked stream comprising $C_6$ or higher circular hydrocarbons and a second cracked stream comprising $C_5$ or lower circular hydrocarbons; and a steam cracker fluidically coupled to the heavy oil cracker to receive the first cracked stream and produce a circular olefin stream.

2. The system of claim 1, wherein the pyrolyzed plastics feed further comprises a naphtha feed.

3. The system of claim 1, wherein the catalytic reforming unit is configured to generate a circular hydrogen stream, and wherein the hydrotreater is further fluidically coupled to the catalytic reforming unit to receive the circular hydrogen stream.

4. The system of claim 1, wherein the steam cracker is further fluidically coupled to the feed fractionator to receive the light hydrocarbon stream.

5. The system of claim 1, further comprising an olefin fractionator fluidically coupled to the steam cracker to receive the circular olefin stream and produce one or more of a circular ethylene stream, a circular propylene stream, or a fractionated pyrolysis gasoline stream comprising $C_6$ or higher circular hydrocarbons.

6. The system of claim 5, further comprising a polymerization unit configured to receive a fractionated circular olefin from the olefin fractionator and polymerize the fractionated circular olefin into a circular polyolefin.

7. The system of claim 6, wherein the circular polyolefin comprises a circular polyethylene or a circular polypropylene.

8. The system of claim 1, wherein the distillation unit is configured to produce a fuel gas stream, and wherein the steam cracker is further coupled to the distillation unit to receive the fuel gas stream.

9. The system of claim 1, wherein the steam cracker is further fluidically coupled to the extractive distillation unit to receive the raffinate stream.

10. The system of claim 5, wherein the hydrotreater is a first hydrotreater, and wherein the system further comprises a second hydrotreater fluidically coupled to the olefin fractionator to receive the fractionated pyrolysis gasoline stream and produce a treated pyrolysis gasoline stream, and wherein the distillation unit is further fluidically coupled to the second hydrotreater to receive the treated pyrolysis gasoline stream.

11. The system of claim 1, further comprising a hydrogenation unit coupled to the extractive distillation unit, wherein the hydrogenation unit is configured to catalytically hydrogenate circular benzene from the circular benzene stream to produce circular cyclohexane.

12. The system of claim 11, further comprising a transalkylation unit fluidically coupled to the distillation unit to receive the heavy aromatics stream and to the aromatics fractionator to receive the circular toluene stream, and configured to produce a mixed xylene stream comprising at least circular para-xylene.

13. The system of claim 1, wherein the medium hydrocarbon stream further comprises $C_9$-$C_{12}$ hydrocarbons, and wherein the system further comprises:

a medium hydrocarbon fractionator fluidically coupled to the hydrotreater to receive the hydrotreated hydrocarbon stream and produce a first fractionated medium hydrocarbon stream comprising $C_6$ to $C_8$ circular hydrocarbons and a second fractionated medium hydrocarbon stream comprising $C_9$ to $C_{12}$ circular hydrocarbons.

14. The system of claim 13, further comprising a full-range naphtha reforming unit comprising a catalyst, wherein the full-range naphtha reforming unit is fluidically coupled to the medium hydrocarbon fractionator to receive the second fractionated medium stream and produce a second circular aromatic-rich stream.

15. The system of claim 14, wherein the catalyst in the full-range naphtha reforming unit comprises platinum on an alumina catalyst support.

16. The system of claim 14, further comprising a distillation unit fluidically coupled to the catalytic reforming unit and to the full-range naphtha reforming unit to receive the first circular aromatic-rich stream and the second aromatic-rich stream and produce a light aromatics stream comprising $C_6$ to $C_8$ circular aromatics and a heavy aromatics stream comprising $C_9$ circular aromatics or higher.

17. The system of claim 16, wherein the distillation unit is a first distillation unit, the system further comprising an extractive distillation unit fluidically coupled to the first distillation unit to receive the light aromatics stream and produce a circular aromatics stream and a raffinate stream.

18. The system of claim 17, further comprising an aromatics fractionator fluidically coupled to the extractive distillation unit to receive the circular aromatics stream and produce one or more of a circular benzene stream, a circular toluene stream, and a circular mixed xylenes stream.

19. The system of claim 18, further comprising a hydrogenation unit coupled to the extractive distillation unit, wherein the hydrogenation unit is configured to catalytically hydrogenate circular benzene from the circular benzene stream to produce circular cyclohexane.

* * * * *